US006469669B1

(12) United States Patent
Tran

(10) Patent No.: US 6,469,669 B1
(45) Date of Patent: Oct. 22, 2002

(54) HYBRID ANTENNA SYSTEM FOR A PORTABLE WIRELESS COMMUNICATION DEVICE

(75) Inventor: Allen Minh-Triet Tran, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/505,232

(22) Filed: Feb. 16, 2000

Related U.S. Application Data

(60) Provisional application No. 60/120,255, filed on Feb. 16, 1999.

(51) Int. Cl.[7] ..... H01Q 1/24

(52) U.S. Cl. ..... 343/702; 343/893; 343/901; 343/876

(58) Field of Search ..... 343/702, 876, 343/879, 883, 893, 900, 901

(56) References Cited

U.S. PATENT DOCUMENTS

| | | | | |
|---|---|---|---|---|
| 4,914,714 A | | 4/1990 | Tamura | 455/78 |
| 4,958,382 A | * | 9/1990 | Imanishi | 455/277 |
| 5,245,350 A | * | 9/1993 | Sroka | 343/702 |
| 5,722,089 A | * | 2/1998 | Murakami | 455/575 |
| 5,731,791 A | | 3/1998 | Jang | 343/702 |
| 5,892,483 A | | 4/1999 | Hayes et al. | 343/729 |

FOREIGN PATENT DOCUMENTS

| | | | |
|---|---|---|---|
| EP | 0843376 | 11/1997 | H01Q/1/08 |
| WO | 9801919 | 1/1998 | H01Q/1/24 |
| WO | 9943040 | 8/1999 | H01Q/1/24 |

* cited by examiner

*Primary Examiner*—Don Wong
*Assistant Examiner*—Shih-Chao Chen
(74) *Attorney, Agent, or Firm*—Philip R. Wadsworth; Charles D. Brown; George C. Pappas

(57) ABSTRACT

A hybrid antenna system for a portable Wireless Communication Device (WCD) includes a concealed, internal shielded substrate antenna fixedly mounted to and wholly internally within a casing of the portable WCD. The hybrid antenna system also includes a displaceable antenna, such as a whip antenna, that is selectively extendable from and retractable within the casing. The antenna system includes a mechanism for electrically connecting the displaceable antenna to internal RF circuitry of the portable WCD when the displaceable antenna is in an extended position and for electrically isolating the displaceable antenna from the internal RF circuitry when the displaceable antenna is in a retracted position within the casing.

4 Claims, 4 Drawing Sheets

HYBRID ANTENNA SYSTEM FOR A PORTABLE WIRELESS COMMUNICATION DEVICE

CROSS-REFERENCE TO RELATED APPLICATIONS

The following application of common assignee contains some common disclosure with that of the present invention: Multi-layered Shielded Substrate Antenna, Ser. No. 09/059,605 (QCPA517), filed, Apr. 13, 1998 and incorporated herein by reference in its entirety. Another related application is Provisional Application entitled "Hybrid Antenna for Portable Wireless Communication", Ser. No. 60/120,255 and filed on Feb. 16,1999.

BACKGROUND OF THE INVENTION

1. Field of Invention

The present invention relates generally to antennas, and more particularly, to a hybrid antenna system including a displaceable whip antenna and a concealed antenna configured for use in a portable wireless communications device.

2. Related Art

In recent years, a substantial increase in the use of personal wireless communications devices (WCDs), such as cellular telephones, has fueled a corresponding increase in the need for suitable antennas for the WCDs. A number of important requirements drive the configuration of such an antenna, including low antenna part and manufacturing costs, compact size, omnidirectional gain and suitable frequency bandwidth, high reliability, pleasing aesthetics or appearance, and comfortable ergonomic packaging.

One type of commonly used antenna configuration includes an elongated whip or monopole/dipole antenna. In one known configuration, the whip antenna selectively extends from or retracts into a cellular telephone casing. An extended whip antenna advantageously maintains a relatively uniform omnidirectional gain pattern even when a user holds the cellular telephone near his or her head because the extended whip antenna extends away from the cellular telephone and the user's head. Therefor, the whip antenna works well in relatively low receive power situations, for example, at the edge of a signal coverage zone or cell. On the other hand, disadvantages arising from the elongate, protruding contour of the whip antenna include a susceptibility to damage and unsightliness to aesthetically sensitive consumers.

Cellular telephones often include a short helical antenna used in conjunction with the whip antenna and activated when the whip antenna is retracted into the casing of the cellular telephone. The helical antenna typically includes a radiator length approximating that of the whip antenna, even though the helical antenna is more compact, more aesthetically pleasing, and less susceptible to damage than the whip antenna. Nevertheless, the helical antenna protrudes substantially and permanently from the cellular telephone so as to adversely impact cellular telephone aesthetics and render the helical antenna susceptible to damage.

Accordingly, cellular telephone manufacturers offer other, more aesthetically pleasing alternatives to the whip and helical antennas, such as an internal antenna housed wholly within and protected by a casing of the cellular telephone. Such an internally mounted antenna permits a cellular telephone manufacturer to construct sleek, aesthetically pleasing, and ergonomically satisfying cellular telephones. Because the internal antenna is encased within the cellular telephone, it works well in relatively high and normal receive signal power situations, but not as well at fringe coverage areas where received signal power is relatively low. Also, while aesthetically more acceptable than the whip antenna, the internal antenna (and the helical antenna mentioned above) suffers adverse antenna gain modification due to antenna loading when the user grasps the casing near the internal antenna, and when the user holds the casing, and thus the internal antenna, near his or her head.

Hence, in an antenna system for a Wireless Communication Device (WCD), there is a need to combine the performance advantages of a whip antenna with the aesthetic and ergonomic advantages associated with an internal antenna, and to mitigate the disadvantages associated with each of these antenna types.

SUMMARY OF THE INVENTION

The present invention provides a hybrid antenna system for a portable WCD. The hybrid antenna system includes a concealed, internal shielded substrate antenna fixedly mounted wholly internally within a casing of the portable WCD. The hybrid antenna system also includes a displaceable antenna, such as a whip antenna, that is selectively extendable from and retractable within the casing. The antenna system includes a mechanism for electrically coupling the displaceable antenna to internal RF circuitry of the portable WCD when the displaceable antenna is in an extended position and for electrically isolating the displaceable antenna from the internal RF circuitry when the displaceable antenna is in a retracted position within the casing.

In a first embodiment, the internal antenna is operatively coupled to the RF circuitry when the displaceable antenna is in both an extended operative position and a retracted inoperative position. Thus, the internal and displaceable antennas are operatively connected in parallel and to the RF circuitry when the displaceable antenna is in the extended position, but only the internal antenna is connected to the RF circuitry when the displaceable antenna is in the retracted position.

In a second embodiment, only one of the displaceable and internal antennas is coupled to the RF circuitry at a time. Specifically, only the displaceable antenna is coupled to the RF circuitry when in the extended operative position, and only the internal antenna is coupled to the RF circuitry when the displaceable antenna is in the inoperative retracted position within the WCD casing. The second embodiment includes two antenna switching arrangements. The first arrangement includes a mechanical switch for switching between antennas while the second arrangement includes an electronic switch for switching between antennas.

The electrical coupling may be effected by a direct electrical connection, by inductive or conductive coupling or by other effective means.

Features and Advantages

The hybrid antenna system combines the performance advantages of a whip antenna with the aesthetic and ergonomic advantages associated with a concealed, internal antenna in a portable WCD.

During normal use of the WCD, that is, when signal coverage is relatively good, the whip antenna is retracted, inoperative, and hidden inside the WCD casing. The operative, concealed internal antenna provides satisfactory performance under such conditions. Thus, most of the time, the WCD maintains a sleek, aesthetically pleasing appearance. However, in those instances where signal coverage is poor, the user extends the higher performing whip antenna to effectively combat the poor signal coverage and to thus extend the useable range of the WCD.

The hybrid antenna system is constructed and arranged in a straight forward manner using relatively few, well known components to reduce antenna system manufacturing complexity, cost, and size.

BRIEF DESCRIPTION OF THE FIGURES

The foregoing and other features and advantages of the invention will be apparent from the following, more particular description of the preferred embodiments of the invention, as illustrated in the accompanying drawings.

DETAILED DESCRIPTION OF THE PREFERRED EMBODIMENTS

Figure 1B:
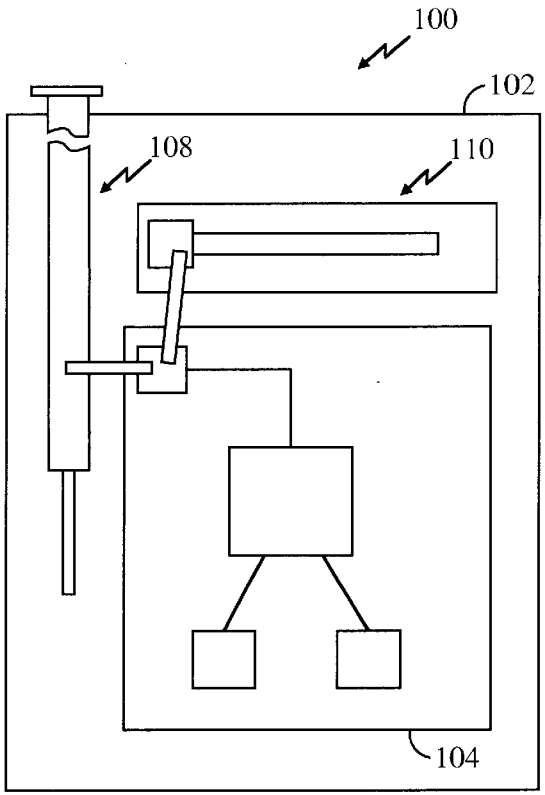
FIG. 1B is a diagram of the hybrid antenna system of FIG. 1A, wherein the whip antenna is depicted in the retracted, inoperative position.
Figure 1A:
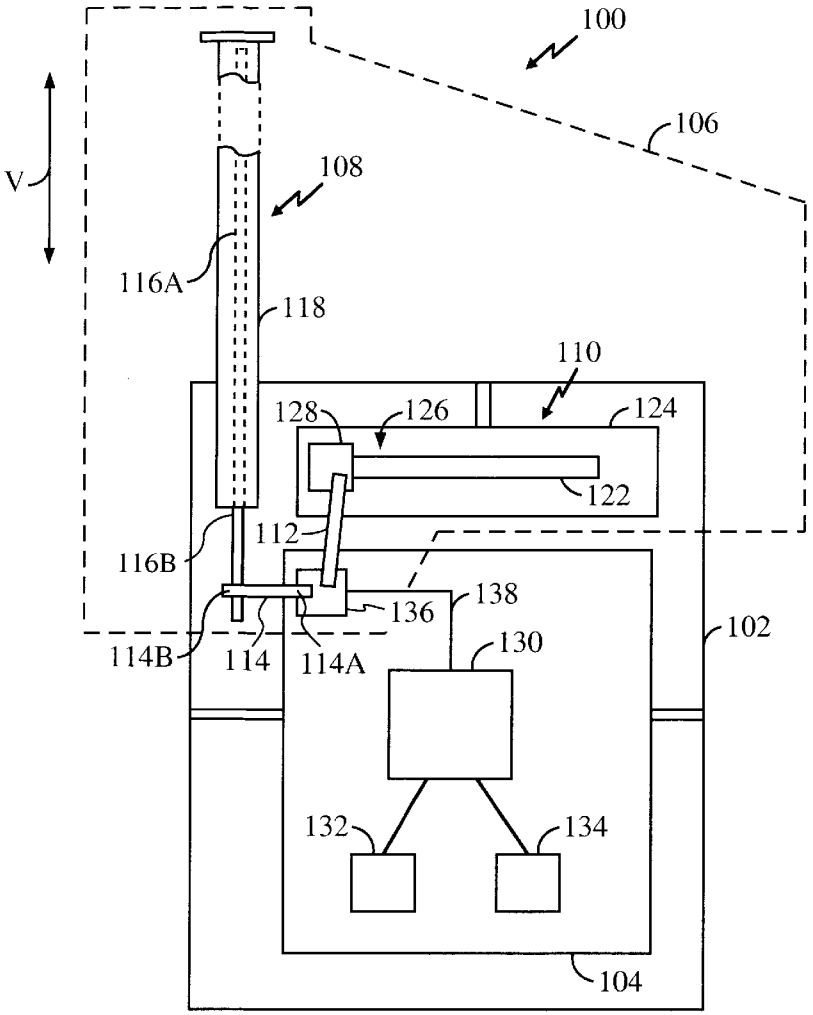
FIG. 1A is a diagram of a first embodiment of a hybrid antenna system in a WCD, wherein a whip antenna is depicted in an extended operative position.

With reference to FIGS. 1A and 1B, a WCD 100 includes a casing or housing 102, a first Printed Circuit Board 104 having RF circuitry of the WCD mounted to or formed on the PCB, and a hybrid antenna system 106 according to a first embodiment of the present invention. Examples of WCD 100 useable with hybrid antenna 106 include a Personal Digital Assistant (PDA), a cellular telephone, a personal communications services (PCS) telephone, and a palm-top computer. Casing 102 can be provided in any convenient shape and style, including, for example, a "brick-shape" or "clam-shell" style used for folding telephones and flip-top hand-held computers.

Hybrid antenna system 106 includes a displaceable antenna 108, such as a whip antenna, and an internal, concealed antenna 110 uniquely configured in the present invention to combine the performance advantages of the whip antenna with the aesthetic and ergonomic advantages associated with the internal antenna. Hybrid antenna system 106 also includes a first electrically conductive connector 112 and a second electrically conductive connector 114 for electrically connecting internal antenna 110 and whip antenna 108 to the RF circuitry on PCB 104, respectively. Connectors 112 and 114 are resilient spring clips in a preferred embodiment.

Whip antenna 108 is slideably received by grooves and/or a guide in casing 102, in a known manner. Whip antenna 108 is thus displaceable in a direction V so as to be selectively extendable from and retractable within casing 102, as is respectively depicted in FIGS. 1A and 1B. Whip antenna 108 is a monopole or dipole radiator of known construction, and includes an elongated, electrically conductive radiator having an upper portion 116*a* and a lower portion 116*b*. An insulating sheath 118 covers and electrically insulates radiator upper portion 116*a*.

Internal antenna 110 (also referred to as a shielded substrate antenna) includes an electrically conductive trace or antenna radiating element 122 formed on a dielectric support substrate or PCB 124, and a signal feed region 126. PCB 124, fixedly mounted to and wholly within casing 102, advantageously spaces radiating element 122 away from the casing to reduce antenna loading effects caused when the user grasps WCD 100 and positions the WCD near his or her head during use of the WCD. Conductive trace 122 can include a plurality of electrically interconnected traces forming a desired antenna radiator structure. Conductive trace 122 includes a conductive pad 128 in signal feed region 126, providing an electrical contact for connecting conductive trace 122 to other circuitry within WCD 100. Shielded substrate antenna 110 may be constructed in accordance with the principles set forth in the aforementioned copending patent application entitled Multi-layered Shielded Substrate Antenna.

PCB 104, fixedly mounted to and within casing 102, has known RF transceiver and electronic circuitry mounted to or formed on the PCB for operating WCD 100. The RF transceiver circuitry includes a duplexer 130 for separating receive and transmit signals, a receive circuit 132 and a transmit circuit 134. A conductive pad 136, electrically connected to the RF circuitry via a conductive trace 138, provides an electrical contact for connecting whip and internal antennas 108 and 110 to the RF circuitry. Respectively providing the RF circuitry and internal antenna 110 on separate PCBs 104 and 124 advantageously adds flexibility in constructing each individual PCB and arranging each PCB in WCD 100. In an alternative arrangement, separate PCBs 104 and 124 can be combined into a single PCB having both the RF circuitry (and other electronic circuitry) and internal antenna 110 formed on or bonded to the single PCB. Using such a single PCB advantageously reduces the number of components and simplifies PCB mounting arrangements in WCD 100.

First resilient spring clip 112 includes opposing ends each respectively bonded to pads 128 and 136 to form a fixed electrical connection between internal antenna 110 and the RF circuitry on PCB 104. Second resilient spring clip 114 includes a first end 114*a* fixed to pad 136 and a second displaceable end 114*b* biased into contact with whip antenna 108. With reference to FIG. 1A, when the whip antenna is in the extended, operative position, clip end 114*b* contacts conductive end 116*b* of whip antenna 108 to electrically connect the whip antenna to the RF circuitry in parallel with internal antenna 110.

With reference to FIG. 1B, when the whip antenna is in the retracted, inoperative position, clip end 114*b* contacts insulating sheath 118, instead of conductor 116*b*, to disconnect (that is, electrically isolate) the whip antenna from the RF circuitry, whereby only internal antenna 110 remains electrically connected to the RF circuitry. It is to be understood that known alternative whip antenna configurations and mechanisms for connecting and disconnecting the whip antenna to and from the RF circuitry are useable in the present invention.

During use of WCD 100, the user places whip antenna 108 into the retracted, inoperative position within casing 102 when communication signal strength at the WCD is at a relatively high or average level, whereby only internal antenna 110 receives and transmits signals. However when additional antenna performance is required to combat poor signal coverage, that is, when signal strength at the WCD is relatively low in rural or fringe signal coverage areas, the user places whip antenna 108 into the extended operative position, whereby both whip antenna 108 and internal antenna 110 receive and transmit signals.

Hybrid antenna system 106 represents a simple and low cost approach for realizing the combined advantages of whip antenna 108 and internal shielded substrate antenna 110. However, use of extended antenna 108 together with internal antenna 110 in the parallel connected antenna configuration described above can degrade receive signal performance at the WCD if antennas 108 and 110 each receive signals that interfere with one another. Accordingly, a second embodiment of the present invention, described below, avoids this drawback.

Figure 2A:
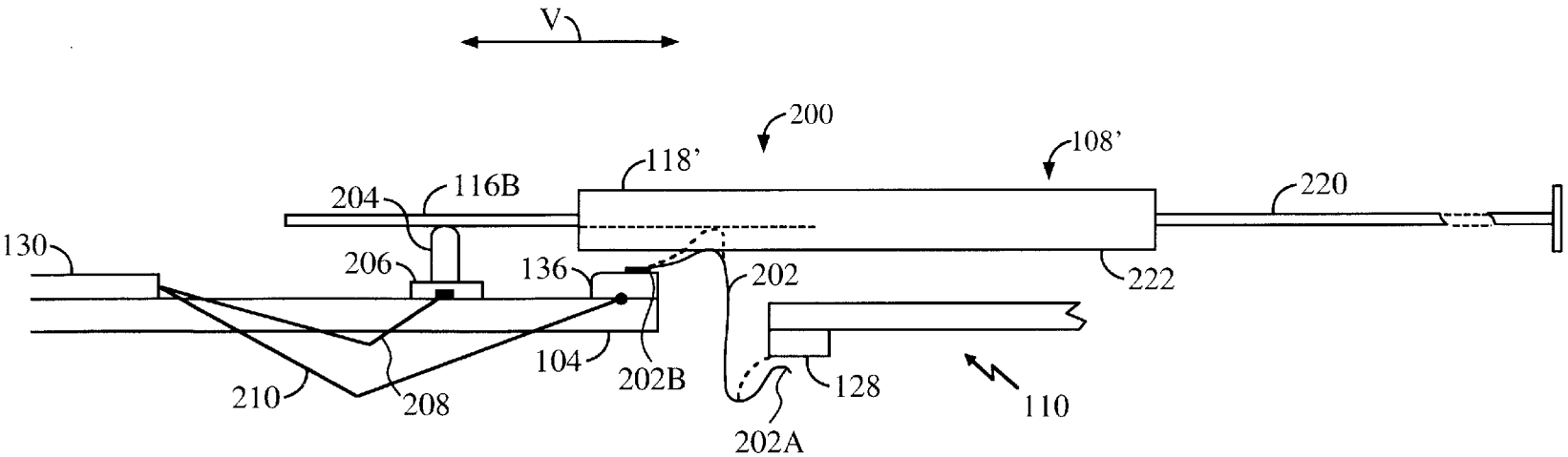
FIG. 2A is a diagram of a second embodiment of a hybrid antenna system for a WCD, wherein a whip antenna is depicted in an extended operative position, and an internal antenna is depicted in an inoperative state.
Figure 2B:
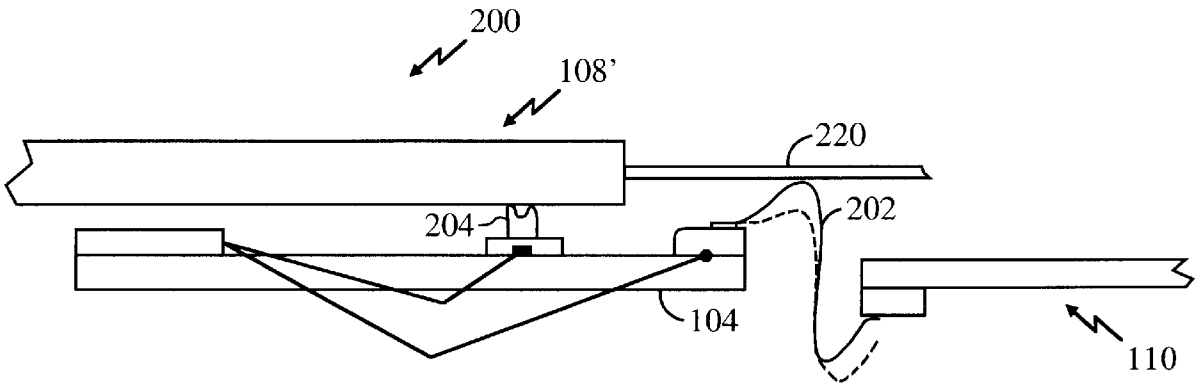
FIG. 2B is a diagram of the hybrid antenna system of FIG. 2A, wherein the whip antenna is depicted in a retracted inoperative position, and the internal antenna is depicted in an operative state.

A hybrid antenna system 200 according to the second embodiment of the present invention, is depicted in FIGS. 2A and 2B. For the sake of clarity, casing 102 and the RF circuitry are not shown in FIGS. 2A and 2B. Hybrid antenna system 200 includes a whip antenna 108' (similar to whip antenna 108), internal antenna 110, a first electrically conductive resilient connector 202 and a second electrically conductive resilient connector 204 for respectively connecting internal antenna 110 and whip antenna 108' to the RF circuitry. Connectors 202 and 204, formed as spring clips, for example, and whip antenna 108' operate together as a mechanical switching mechanism for electrically connecting and disconnecting each antenna 108' and 110 from the RF circuitry, as is described below. Hybrid antenna system 200 advantageously avoids the above mentioned interference effects by electrically connecting only one antenna, either antenna 108' or antenna 110, to the RF circuitry at a time.

Whip antenna 108' includes conductive end portion 116*b* and an opposing end portion 220 spaced from end portion 116*b*. An insulating sheath 118' extends between opposing end portions 116*b* and 220. Sheath 118' has a diameter that is greater than the diameters of the end portions 116*b* and 220. Spring clip 204 is electrically connected to the RF circuitry via a conductive pad 206 and a conductive trace 208 formed on PCB 104 (but depicted displaced from PCB 104 for the sake of clarity). Spring clip 204 is sized to contact end portion 116*b* of whip antenna 108' when the whip antenna is in the extended position, as depicted in FIG. 2A, to thereby electrically connect the whip antenna to the RF circuitry. On the other hand, spring clip 204 contacts insulating sheath 118' when whip antenna 108' is in the retracted position, as depicted in FIG. 2B, to thereby disconnect the whip antenna from the RF circuitry.

Spring clip 202 includes a first end 202*b* bonded to pad 136 and connected to the RF circuitry by a conductive trace 210 of PCB 108. Spring clip 202 is sized and shaped to bias a second displaceable end 202*a* of the spring clip into contact with conductive pad 128 of internal antenna 110 when whip antenna 108' is in the retracted position, as depicted in FIG. 2B (and in FIG. 2A by dotted line), to thereby connect internal antenna 110 to the RF circuitry. On the other hand, sheath 118' of whip antenna 108' contacts spring clip 202 when the whip antenna is in the extended position, as depicted in FIG. 2A, and thereby displaces clip end 202*a* away from pad 128 to disconnect the whip antenna from the RF circuitry. Accordingly, only whip antenna 108' or internal antenna 110 is electrically connected to the RF circuitry when the whip antenna is respectively in the extended or retracted positions.

Figure 3:
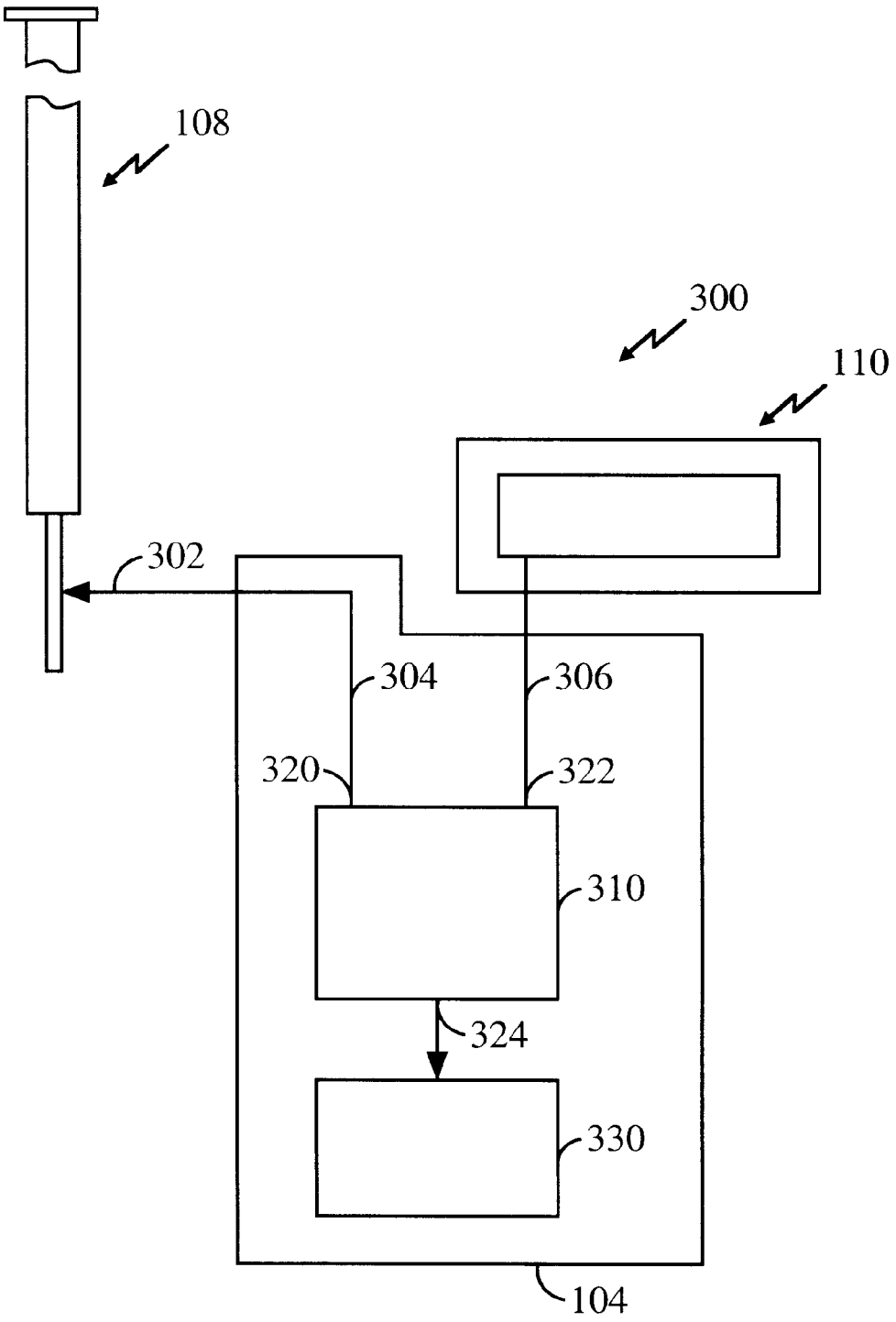
FIG. 3 is a diagram of an alternative arrangement of the hybrid antenna system of the second embodiment, wherein an electronic switch switches between a whip antenna and an internal antenna, according to the present invention.

An alternative hybrid antenna system 300 according to the second embodiment, is depicted in FIG. 3. Hybrid antenna system 300 uses a combination of mechanical and electrical switching techniques to selectively connect either whip antenna 108 or internal antenna 110 to the RF circuitry. Hybrid antenna system 300 includes a mechanical connector 302 for selectively, electrically connecting and disconnecting whip antenna 108 to a conductive trace 304 on PCB 104 when the whip antenna is in the extended and retracted positions, respectively, in a manner similar to that described in connection with FIGS. 1A and 1B. Internal antenna 110 is electrically connected to a conductive trace 306 on PCB 104 using a fixed electrical connection, in a manner similar to that described in connection with FIGS. 1A and 1B.

Hybrid antenna system 300 includes an electronic switch 310 on PCB 104 having a first input 320 connected to conductive trace 304, a second input 322 connected to conductive trace 306, and an output 324 connected to the RF circuitry (collectively indicated by reference numeral 330). Electronic switch 310 selectively connects first input 320 and thus whip antenna 108 or second input 322 and thus internal antenna 110 to the RF circuitry 330, when the whip antenna respectively occupies the extended operative and retracted inoperative positions.

Figure 4:
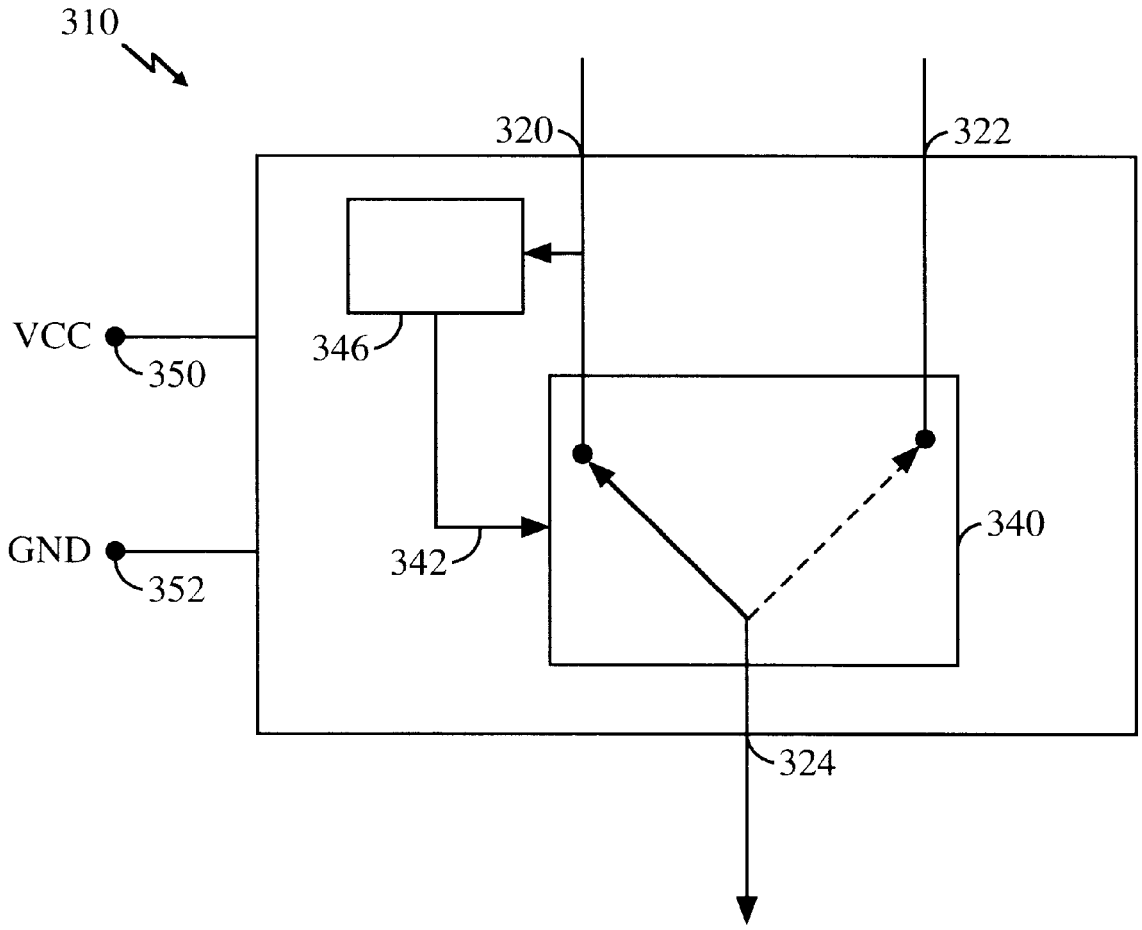
FIG. 4 is a functional diagram of the electronic switch of FIG. 3.

A detailed diagram of electronic switch 310 is depicted in FIG. 4. Electronic switch 310 includes a switching element 340, functionally illustrated in FIG. 4. Switching element 340 connects either input 320 (depicted in solid line) or input 322 (depicted in dotted line) to output 324 in response to a switching control voltage applied to switching element 340 via a select line 342. Switching element 340 can be implemented using switching pin diodes controlled by the switching control voltage, as is known. Electronic switch 310 also includes an antenna load sensing circuit 346 for sensing when whip antenna 108 is connected to input 320 via connector 302 and PCB trace 304, and for deriving the switching control voltage applied to switching element 340 in response to a load that is sensed. A supply voltage Vcc and a ground potential Gnd are respectively applied to a terminal 350 and 352 of switch 310, for operating electronic switch 310.

In operation, antenna load sensing circuit 346 senses an antenna load, of fifty or seventy-five Ohms, for example, when whip antenna 108 is extended and operatively connected to input 320 by connector 302. In response, sensing circuit 346 applies an appropriate control voltage to switching element 340 to connect whip antenna 108 to RF circuitry 330 (depicted by solid line in FIG. 4). On the other hand, antenna load sensing circuit 346 senses a lack of antenna loading when whip antenna 108 is retracted and disconnected from input 320 by connector 302. In response, sensing circuit 346 applies an appropriate control voltage to switching element 340 to disconnect whip antenna 108 from and connect internal antenna 108 to RF circuitry 330 (depicted by dotted line in FIG. 4)

While various embodiments of the present invention have been described above, it should be understood that they have been presented by way of example only, and not limitation. Thus, the breadth and scope of the present invention should not be limited by any of the above-described exemplary embodiments and arrangements, but should be defined only in accordance with the following claims and their equivalents.

What is claimed is:

1. A portable communications device (PCD) having an internal antenna and a displaceable antenna connected to a common internal RF circuitry, the internal and displaceable antennas being simultaneously operatively electrically coupled in parallel to the common internal RF circuitry so as to maximize signal gain when the displaceable antenna is not in a retracted position, while when the displaceable antenna is retracted, only the internal antenna is operatively electrically coupled to the common internal RF circuitry.

2. The PCD of claim 1, further including a switching circuit for electrically isolating the internal antenna from common internal RF circuitry when a predetermined impedance in the displaceable antenna is detected.

3. The PCD of claim 1, further comprising a printed circuit board (PCB) on which components of the common internal RF circuitry are formed and which includes the internal antenna.

4. The PCD of claim 1, wherein the internal antenna is a shielded substrate antenna comprised of an electrically conductive trace formed on a printed circuit board fixed to and within a casing of the PCD.

* * * * *